US008505140B2

(12) United States Patent
Anderberg

(10) Patent No.: US 8,505,140 B2
(45) Date of Patent: Aug. 13, 2013

(54) MOVABLE PASSENGER BRIDGE FOR A SHIP

(75) Inventor: Nils-Erik Anderberg, Trelleborg (SE)

(73) Assignee: FMT International Trade AB, Trelleborg (SE)

( * ) Notice: Subject to any disclaimer, the term of this patent is extended or adjusted under 35 U.S.C. 154(b) by 0 days.

(21) Appl. No.: 13/367,774

(22) Filed: Feb. 7, 2012

(65) Prior Publication Data

US 2012/0204364 A1 Aug. 16, 2012

(30) Foreign Application Priority Data

Feb. 7, 2011 (SE) ..... 1150086

(51) Int. Cl.
*B63B 27/14* (2006.01)

(52) U.S. Cl.
USPC ..... 14/71.1; 14/71.5; 114/362; 414/137.1

(58) Field of Classification Search
CPC ..... B64F 1/305
USPC ..... 14/71.1, 71.5; 114/362; 414/137.1, 414/737.2, 137.2
See application file for complete search history.

(56) References Cited

U.S. PATENT DOCUMENTS

| | | | | |
|---|---|---|---|---|
| 3,046,908 | A * | 7/1962 | Der Yuen | 104/20 |
| 3,524,207 | A * | 8/1970 | Giarretto | 14/71.5 |
| 3,538,529 | A * | 11/1970 | Breier | 14/71.5 |
| 4,990,029 | A * | 2/1991 | Hemminger | 405/203 |
| 5,853,150 | A * | 12/1998 | Kuchenbrod | 244/137.2 |
| 6,487,743 | B1 * | 12/2002 | Nicoletti | 14/71.5 |
| 6,526,615 | B1 * | 3/2003 | Hutton et al. | 14/71.5 |
| 6,668,411 | B1 * | 12/2003 | Anderberg | 14/69.5 |
| RE38,804 | E * | 10/2005 | Stephenson et al. | 14/71.5 |
| 8,069,518 | B2 * | 12/2011 | Saito et al. | 14/71.5 |
| 2002/0138924 | A1 * | 10/2002 | Rolfe et al. | 14/71.5 |
| 2009/0255066 | A1 * | 10/2009 | Brock | 14/69.5 |

FOREIGN PATENT DOCUMENTS

| | | | |
|---|---|---|---|
| CN | 201202086 | Y | 3/2009 |
| GB | 2111449 | A | 7/1983 |
| JP | 410140522 | A | 5/1998 |

* cited by examiner

*Primary Examiner* — Raymond W Addie
(74) *Attorney, Agent, or Firm* — Young & Thompson

(57) ABSTRACT

A movable passenger bridge for embarking and disembarking a ship includes sections, each pair of adjacent sections connected at respective ends by shorter transfer sections, arranged so that passengers can walk from section to section. The sections and the transfer sections are supported by a framework of steel beams. The sections are displaceably arranged relative to the framework, forming an angle relative to the horizontal plane, accommodating a height difference between first and second ports. The framework is supported by wheel arrangements that abut against a quay. An entry module by the first port, on the one hand is connectable to a first of the sections, on the other hand is connected to the transfer section which is located closest to and lying in the same vertical plane as the entry module, whereby a connection can be established from the entry module directly into the second transfer section.

20 Claims, 4 Drawing Sheets

MOVABLE PASSENGER BRIDGE FOR A SHIP

Figure 1:
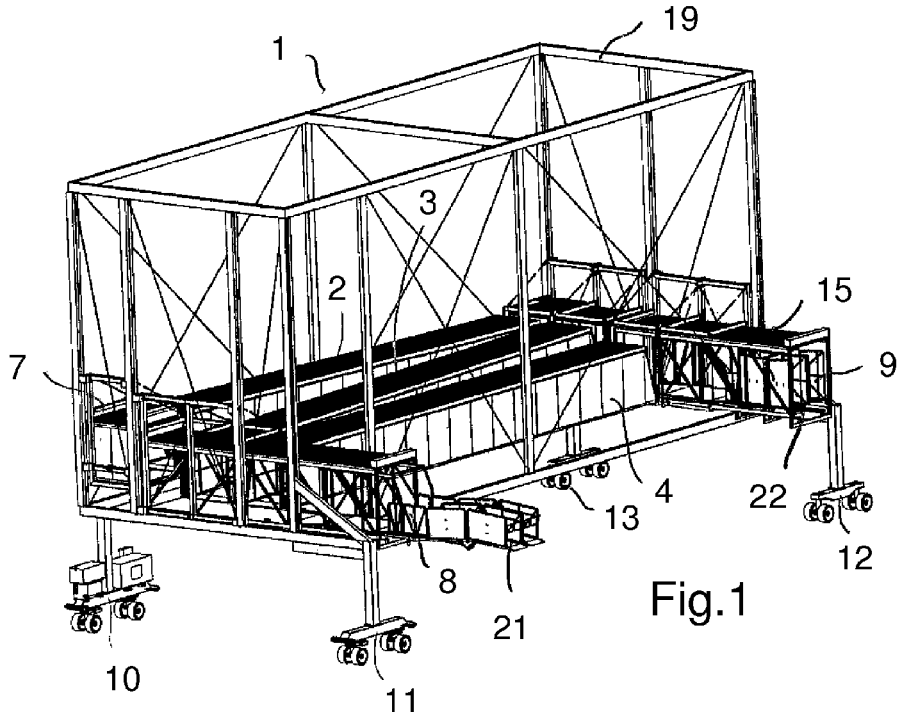

The present invention relates to a movable passenger bridge for a ship.

The passenger bridge is preferably arranged to be connected, at one of its ends, to a terminal building, and arranged to, with its other end, be connected to a door opening in the hull of a ship.

The passenger bridge comprises several sections of passenger bridges, connected one to the other so that passengers can walk through one section and into another section.

The applicant's own U.S. Pat. No. 6,668,411 discloses a passenger bridge of this type. The passenger bridge according to the said U.S. patent comprises an odd number of sections of passenger bridges, however at least three. Between said sections, there are shorter passenger bridges, in the form of transfer sections by the use of which passengers walk from one section of the passenger bridge to another section. The sections can be individually raised and lowered, so that the first end of the passenger bridge can be connected to a terminal building or the corresponding, and so that the other end of the passenger bridge can be connected to a door in the hull of a ship.

Furthermore, the sections are arranged to form an angle to the horizontal plane, in order to adapt to elevation differences between an entrance/exit into or out from a terminal building and the said door in the hull of the ship. Suitably, the sections can be angled in relation to the horizontal plane at an inclination of 1:12. The said height difference can be for example 5-15 meters. The length of each section can be 40-55 meters, depending on expected height differences.

The said transfer sections preferably remain horizontal, even if the sections form an angle in relation to the horizontal plane.

Moreover, the passenger bridge is supported by a frame, which frame supports the sections and the transfer sections. The frame, in turn, is supported by a number of wheels, resting on a quay on which the ships are landed. The passenger bridge is movable along two mutually perpendicular directions, by one or several wheels being driven.

At least the section the free end of which is to be connected to a ship may be telescopic in its longitudinal direction.

A passenger bridge according to the US patent is controlled so that it connects to a terminal building and so that the sections are inclined to such an extent so that the total inclination corresponds to the height difference between the door opening in the terminal building and the door opening in the hull of the ship. As mentioned, the passenger bridge has at least three sections with intermediate transfer sections. The passenger bridge is so designed that a passenger first must walk through a first section and then walk, via a transfer passenger bridge, through a second section and then, via a transfer section, through a third section. In case each section has a length of for example 50 meters, this means that the passengers must walk more than 150 meters, even if the said height difference is so small that it can be absorbed by one section, in other words about 4 meters. From the passengers' point of view, this is perceived as cumbersome and time consuming.

The present invention solves this problem.

Hence, the present invention relates to a movable passenger bridge for embarking and disembarking a ship, which passenger bridge comprises a number of sections of the passenger bridge, where each pair of two adjacent sections are connected at their respective ends by a first and a second shorter transfer section, arranged so that passengers can walk from one section into an adjacent section via a transfer section, where the sections and the transfer sections are supported by a framework of steel beams and where said sections are displaceably arranged relative to the framework, so that these can form an angle in relation to the horizontal plane, so that a height difference between a first port, arranged to be connected to an opening in a terminal building or the corresponding, and a second port, arranged to be connected to an opening in the hull of the ship, can be absorbed, and wherein the framework is supported by wheel arrangements arranged to abut against a quay, where at least one wheel arrangement is driven in order to manoeuvre the passenger bridge on a quay.

The invention is characterised in that an entry module, arranged by the said first port, on the one hand is connectable to a first of the sections of the passenger bridge, on the other hand is connected to the second transfer section, lying in the same vertical plane as the entry module, whereby a connection can be established from the entry module directly into the second transfer section.

Figure 2:
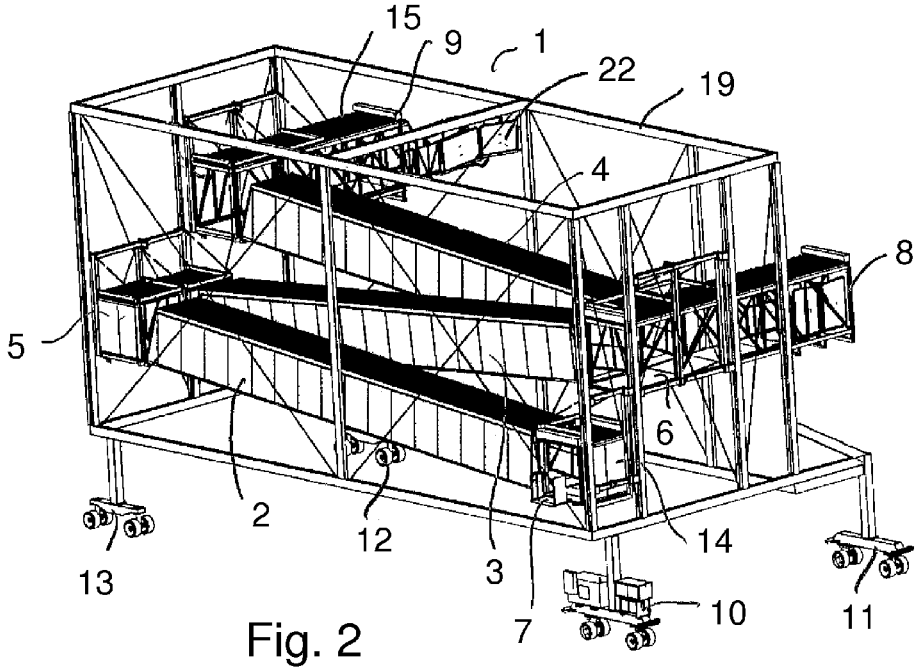
Figure 3:
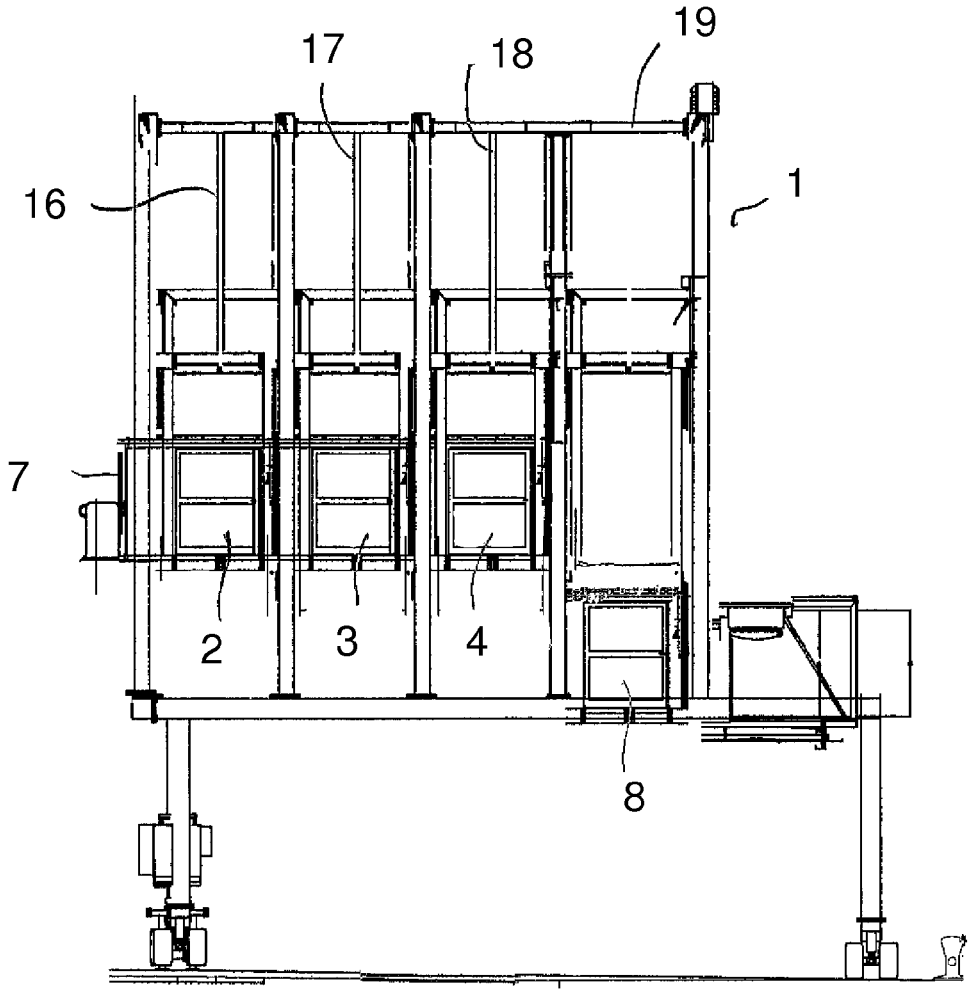
Figure 6:
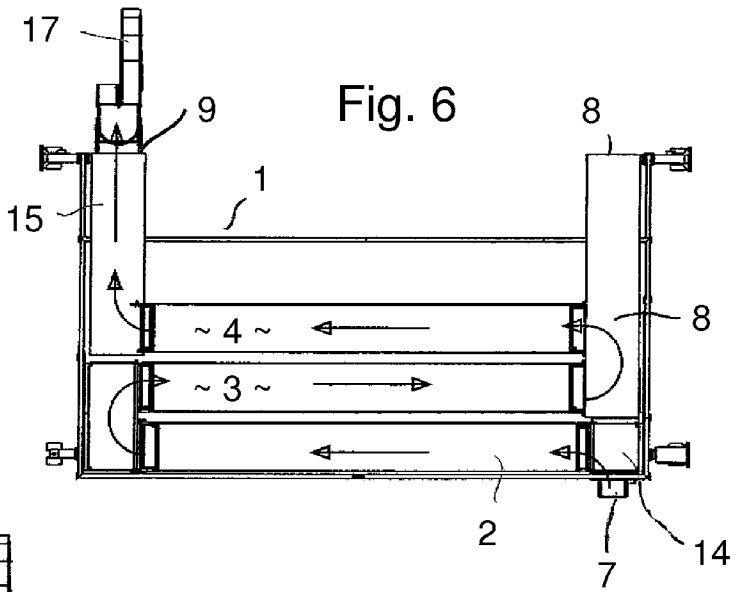
Figure 5:
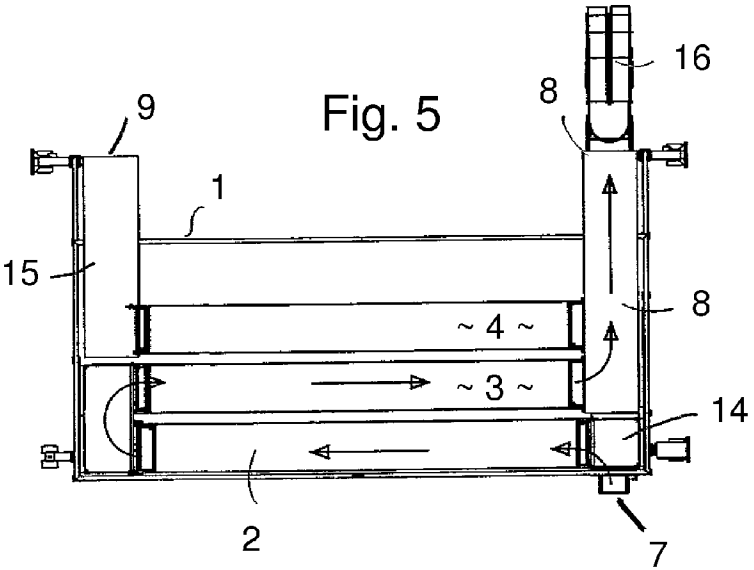
Figure 4:
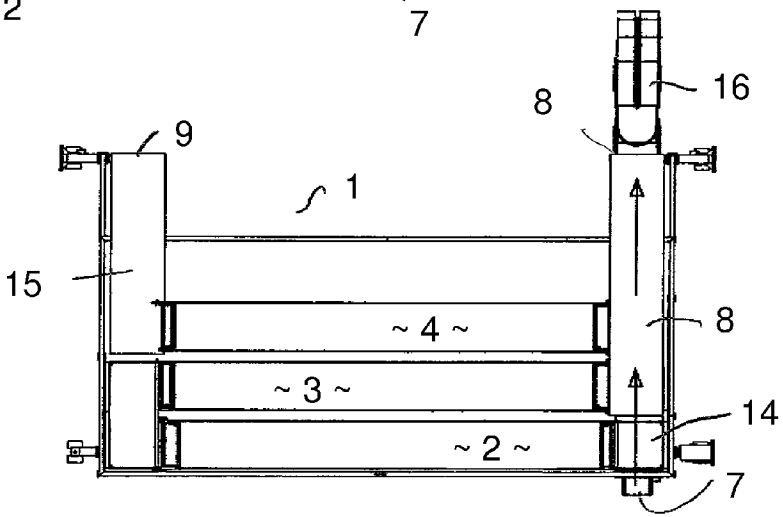
Figure 7:
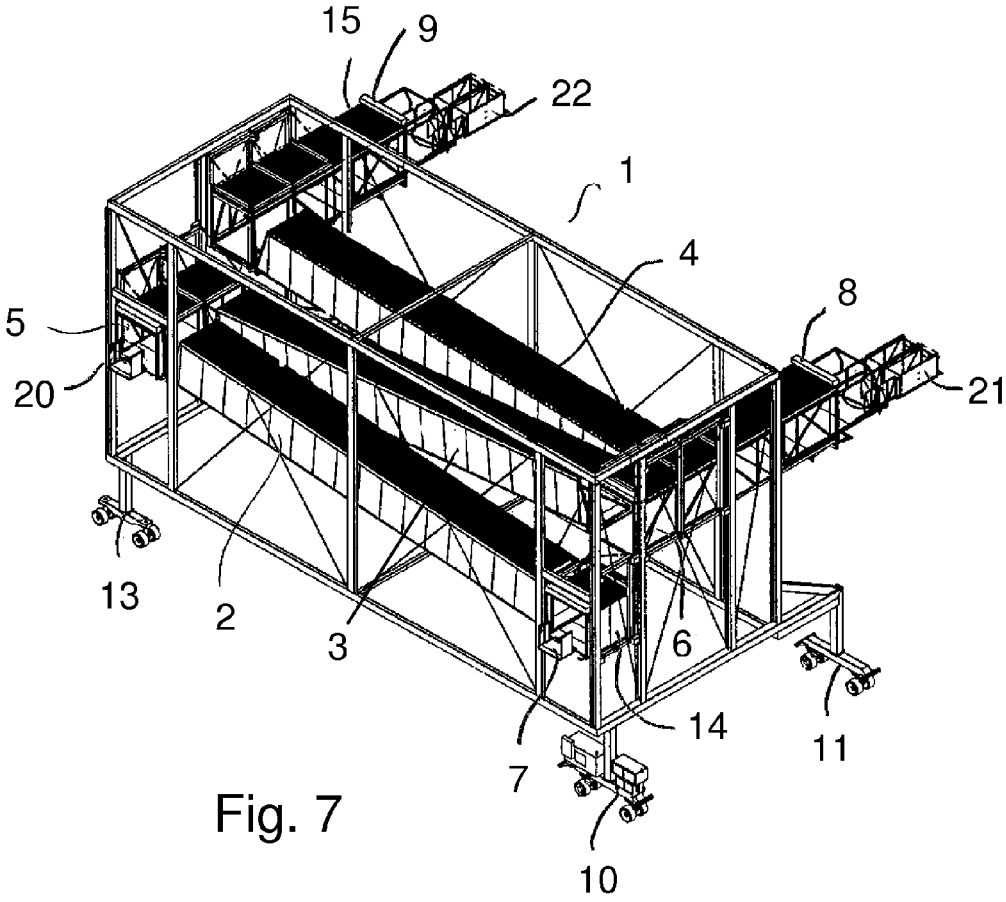

In the following, the invention is described in closer detail, partly in connection to an embodiment of the invention as shown on the enclosed drawings, where FIG. 1 shows a perspective view of a passenger bridge according to the invention from a first viewpoint and in a first state FIG. 2 shows a perspective view of a passenger bridge according to the invention from a second viewpoint and in a second state FIG. 3 shows the passenger bridge in a horizontal direction and standing on a quay FIGS. 4, 5 and 6 illustrate different settings of the passenger bridge according to the invention as seen from above and broken FIG. 7 shows an additional embodiment of a passenger bridge according to the invention.

In FIGS. 1 and 2, a movable passenger bridge 1, according to the invention, for embarking and disembarking a ship is shown.

The passenger bridge 1 comprises a number of sections 2, 3, 4 of the passenger bridge, where two adjacent sections are connected at their respective ends by shorter transfer sections 5, 6, arranged so that passengers can walk from one section into an adjacent section via a transfer section.

The sections 2, 3, 4 and the transfer sections 5, 6 are supported by a framework 19 of steel beams.

The said sections 2, 3, 4 are displaceably arranged relative to the framework 19, so that these can form an angle to the horizontal plane, in order to achieve that a height difference between a first port 7, arranged to be connected to an opening in a terminal building or the like, and a second port 8, 9, arranged to be connected to an opening in the hull of the ship can be absorbed.

The sections 2, 3, 4 and the transfer sections 5, 6 are supported and manoeuvrable using hydraulic cylinders 16, 17, 18, see FIG. 3, and/or wire systems, not shown, in a known and conventional way.

The framework 19 is supported by wheel arrangements 10-13, arranged to abut against a quay. At least one wheel arrangement 10 is arranged to manoeuvre the passenger bridge 1 on the quay. This and the other three wheel arrangements are pivotable about a vertical axis. Each wheel arrangement may comprise a number of wheels, for instance four.

To displace and adjust the sections and, as mentioned below, a transfer section, as well as for manoeuvring of the passenger bridge on the quay, there is a control system of a suitable known type, with control panels at suitable locations in the passenger bridge and/or remote control equipment for controlling the control system.

In FIGS. 1 and 2, sections 2, 3, 4 and the transfer sections 5, 6 are shown in different height positions relative to the framework.

Hence, passengers which are to embark walk from for instance a terminal building and into port 7, and then walk through section 2, transfer section 5, section 3, transfer section 6, section 4 and out through port 9 into the ship. By displacing the ends of the sections, so that the sections are inclined, the total inclination will absorb the height difference between port 7 and port 9. The transfer sections are jointed to the sections, so that the transfer sections follow the sections when these are displaced vertically.

According to the invention, an entry module 14 is located by the said first port 7, on the one hand connectable to a first 2 of the sections of the passenger bridge, on the other hand connectable to that one of the transfer sections 6 which is located closest to and in the same vertical plane as the entry module 14, whereby a connection can be established from the entry module directly to the last mentioned transfer section 6. In FIG. 2, this is illustrated by the state shown in FIG. 2, where the entry module 14 is connected to the section 2, but if the transfer section 8 is lowered to the level of the entry module 14, a connection will be established, where passengers can walk through the first port 7, through the entry module 14 and thereafter directly through the transfer section 6 to the port 8 into the ship. In FIG. 4, the last mentioned case is illustrated, where the arrows indicate the passage way of the passengers. In FIG. 6, the other case is illustrated, in which the passengers walk into the entry module 14 and thereafter are led into the section 2.

According to a very preferred embodiment, the transfer section 6 is also arranged vertically displaceable, so that it can be inclined relative to the horizontal plane, whereby height differences between the entry module and the other port 8 can be absorbed by the transfer module.

In case the passenger bridge is connected to an opening in the hull of a ship, which does not display any height difference between port 7 and port 8, or a height difference which can be absorbed by the transfer section 6, then the passengers can simply walk straight ahead through the passenger bridge from the terminal building and into the ship.

According to a preferred embodiment, the transfer section 6 located at the entry module 14 and/or a finishing section 15 located furthest away from the entry module 14 is arranged with the said second port 8, 9.

According to a preferred embodiment, there is one additional entry module 20 at the second transfer section 5, which is located at an opposite end of the first one of the sections 2 of the passenger bridge in relation to the first mentioned entry module 14, see FIG. 7. The second transfer section 5, which is located in the same vertical plane as the additional entry module 20, is on the one hand connectable to sections 2, 3 of the passenger bridge, on the other hand connectable to a finishing section 15, which lies in the same vertical plane as the second transfer section. Hereby, a connection can be established from the entry module 20 directly into the finishing section 15.

According to another preferred embodiment, the finishing section 15 is arranged to be vertically displaceable, so that it can be inclined relative to the horizontal plane.

According to a preferred embodiment, the transfer section 6 and/or the finishing section 15 are telescopably arranged, so that an inner part of the transfer section 6 and the finishing section 15 are displaceable inwards and outwards from an outer part of the transfer section 6 and the finishing section 15, that is in the same way as conventional passenger bridges are arranged to be connected to airplanes.

To the ports 8, 9, a ramp 21, 22 is connected. The ramp 21, 22 is arranged to project a certain distance into the opening of the ship in order to take up smaller movements of the ship relative to the quay.

That there are two ports 8, 9 increases the flexibility regarding the position of the passenger bridge relative to the ship for connecting the port 7 of the passenger bridge to the terminal building and the port 8, 9 of the passenger bridge to the ship.

To arrange two ports 8, 9 also admits that the passenger bridge can have several sections, depending on the height above the quay of the terminal building and the height above the quay of the opening of the ship.

According to a preferred embodiment, the number of sections 2, 3, 4 is between two and seven.

In FIGS. 4-6, it is illustrated that the passengers walk straight through without walking into a section, FIG. 4, to walking along two sections 2, 3, FIG. 5, to walking along three section 2, 3, 4, FIG. 6.

According to a preferred embodiment, in connection to the opening in both respective ends of each section 2, 3, 4, there is a blocking means, not shown, in the form of a conventional pivotable bar gate or a door, in order to guide the passengers to the right place.

It is apparent that the present invention solves the initially mentioned problem.

Above, a number of different embodiments have been described. However, it is apparent that the invention can be varied regarding the design of the sections and transfer sections, as well as regarding the number of sections.

Therefore, the present invention shall not be considered limited to the above described embodiment, but may be varied within the scope of the enclosed claims.

The invention claimed is:

1. Movable passenger bridge for embarking and disembarking a ship, which passenger bridge comprises a number of sections (2, 3, 4) of the passenger bridge, where each pair of two adjacent sections (2, 3; 3, 4) are connected at their respective ends by a first transfer section (5) and a shorter, second transfer section (6), arranged so that passengers can walk from one section into an adjacent section via a transfer section, where the sections and the transfer sections are supported by a framework (19) of steel beams and where said sections (2, 3, 4) are displaceably arranged relative to the framework, so that these can form an angle in relation to the horizontal plane, so that a height difference between a first port (7), arranged to be connected to an opening in a terminal building or the corresponding, and a second port (8, 9), arranged to be connected to an opening in the hull of the ship, can be absorbed, and wherein the framework is supported by wheel arrangements (10-13) arranged to abut against a quay, where at least one wheel arrangement (10) is driven in order to manoeuvre the passenger bridge on a quay, wherein an entry module (14), arranged by said first port (7), i) is connectable to a first of the sections (2) of the passenger bridge, and ii) is connected to the second transfer section (6), lying in the same vertical plane as the entry module (14), whereby a connection can be established from the entry module (14) directly into the second transfer section (6).

2. Passenger bridge according to claim 1, wherein an additional entry module (20) is arranged by the first transfer section (5), which in turn is located at the opposite end of the first of the sections (2) of the passenger bridge in relation to the first mentioned entry module (14), in that the first transfer section (5), which is located in the same vertical plane as the additional entry module (20), on the one hand is connectable to sections (2, 3) of the passenger bridge, on the other hand is connectable to a finishing section (15), which in turn lies in the same vertical plane as the first transfer section (5), whereby a connection can be established from the additional entry module (20) directly into the finishing section (15).

3. Passenger bridge according to claim 1, wherein the transfer section (6) located by the entry module (14) is arranged with said second port (8).

4. Passenger bridge according to claim 1, wherein the finishing section (15) is arranged with said second port (9).

5. Passenger bridge according to claim 1, wherein the transfer section (6) is arranged to be vertically displaceable, so that it can be inclined relative to the horizontal plane.

6. Passenger bridge according to claim 1, wherein the finishing section (15) is arranged to be vertically displaceable, so that it can be inclined relative to the horizontal plane.

7. Passenger bridge according to claim 1, wherein the number of sections (2, 3, 4) is between two and seven.

8. Passenger bridge according to claim 1, wherein there is a blocking means in the form of a pivotable bar gate or a door in connection to the opening of each section (2, 3, 4) in both ends.

9. Passenger bridge according to claim 1, wherein the sections (2, 3, 4) are supported and manoeuvrable using hydraulic cylinders and/or a wire system.

10. Passenger bridge according to claim 1, wherein the transfer section (6) is telescopably arranged, so that an inner part of the transfer section (6) is displaceable inwards and outwards from an outer part of the section (6).

11. Passenger bridge according to claim 1, wherein the finishing section (15) is telescopably arranged, so that an inner part of the finishing section (15) is displaceable inwards and outwards from an outer part of the finishing section (15).

12. Passenger bridge according to claim 2, wherein the transfer section (6) located by the entry module (14) is arranged with said second port (8).

13. Passenger bridge according to claim 2, wherein the finishing section (15) is arranged with said second port (9).

14. Passenger bridge according to claim 3, wherein the finishing section (15) is arranged with said second port (9).

15. Passenger bridge according to claim 2, wherein the transfer section (6) is arranged to be vertically displaceable, so that it can be inclined relative to the horizontal plane.

16. Passenger bridge according to claim 3, wherein the transfer section (6) is arranged to be vertically displaceable, so that it can be inclined relative to the horizontal plane.

17. Passenger bridge according to claim 4, wherein the transfer section (6) is arranged to be vertically displaceable, so that it can be inclined relative to the horizontal plane.

18. Passenger bridge according to claim 2, wherein the finishing section (15) is arranged to be vertically displaceable, so that it can be inclined relative to the horizontal plane.

19. Passenger bridge according to claim 3, wherein the finishing section (15) is arranged to be vertically displaceable, so that it can be inclined relative to the horizontal plane.

20. A movable passenger bridge for embarking and disembarking a ship, the passenger bridge comprising:

plural passenger bridge sections (2, 3, 4) defining a pair of adjacent passenger bridge sections (2, 3; 3, 4);

a first transfer section (5) and a shorter, second transfer section (6) connecting the pair of two adjacent passenger bridge sections (2, 3; 3, 4) at respective ends thereof, the connected pair of two adjacent passenger bridge sections (2, 3; 3, 4) being arranged so that passengers can walk from one passenger bridge section into an adjacent passenger bridge section via one of the first and second transfer sections;

a framework (19) of steel beams supporting the passenger bridge sections and the first and second transfer sections, said passenger bridge sections (2, 3, 4) being displaceably arranged relative to the framework so that the passenger bridge sections (2, 3, 4) form an angle in relation to a horizontal plane, and so that a height difference between i) a first port (7), arranged to be connected to an opening in a terminal building, and ii) a second port (8, 9), arranged to be connected to an opening in a hull of the ship, is absorbed, and wheel arrangement (10-13) supporting the framework, the wheel arrangements (10-13) arranged to abut against a quay; and an entry module (14), when arranged by said first port (7), is i) connectable to a first of the passenger bridge sections (2), and at the same time ii) is connectable to the second transfer section (6), lying in the same vertical plane as the entry module (14), in order to establish a connection from the entry module (14) directly into the second transfer section (6) with the entry module (14) connected to the first of the passenger bridge sections (2) and connected to the second transfer section (6).

* * * * *